United States Patent [19]

Farstad

[11] 4,051,800

[45] Oct. 4, 1977

[54] ANCHOR-WIRE ARRANGEMENT

[76] Inventor: Lars Farstad, Heimstadvn. 7, 7000 Trondheim, Norway

[21] Appl. No.: 671,958

[22] Filed: Mar. 30, 1976

[51] Int. Cl.[2] ..... B63B 21/24

[52] U.S. Cl. ..... 114/297

[58] Field of Search ..... 114/206 R, 51, 297; 9/9

[56] References Cited

U.S. PATENT DOCUMENTS

| | | | |
|---|---|---|---|
| 1,059,548 | 4/1913 | Loucks | 9/9 |
| 1,605,343 | 11/1926 | Gould et al. | 9/9 |
| 3,654,649 | 4/1972 | Richardson | 114/206 R |
| 3,842,780 | 10/1974 | Allens et al. | 114/206 R |
| 3,929,087 | 12/1975 | Montgomery | 114/206 |

*Primary Examiner*—Trygve M. Blix
*Assistant Examiner*—Gregory W. O'Connor

[57] ABSTRACT

Use of a light-hauling-up line in connection with a disengaging chain or wire (pendant wire) which is attached to the head of a large anchor placed on the bottom of the sea. The hauling-up line extends from the disengaging wire which lies on the bottom of the sea, up to the surface where it is fastened to a buoy. The hauling-up is intended to draw up the disengaging wire to a craft which will raise the anchor.

3 Claims, 1 Drawing Figure

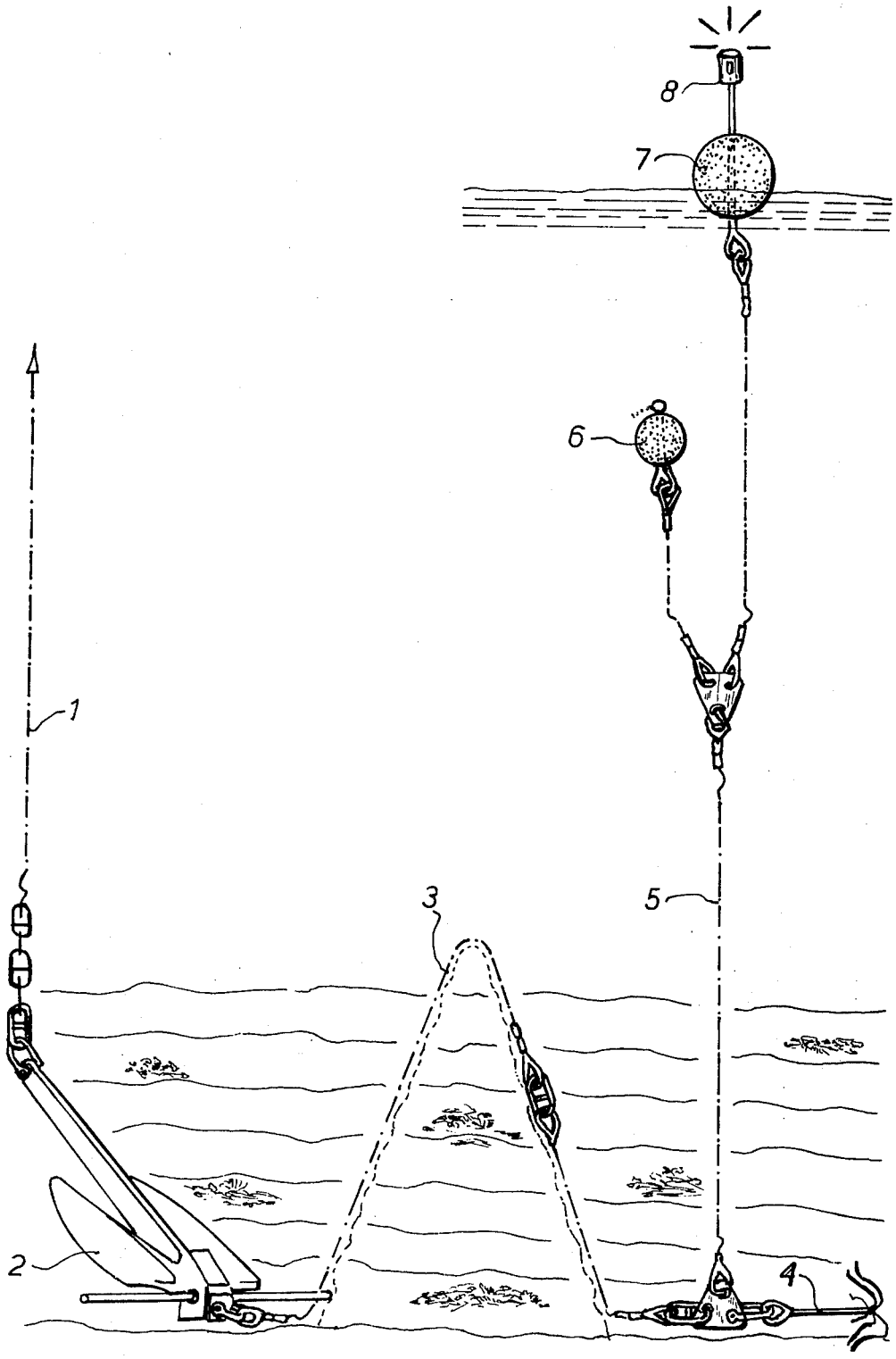
8
7
6
1
3
5
2
4

ANCHOR-WIRE ARRANGEMENT

The invention relates to an anchor-wire arrangement for e.g. drilling vessel and drilling platforms when these are lying at anchor while engaging in underwater drilling.

Drilling vessels and semi-submerged drilling platforms and the like have a very heavy and costly anchor arrangement. It consists of several heavy and expensive anchors which are attached to the drilling platform or the like by means of anchor chains, and which on account of their construction are dug deep into the bottom of the sea. On account of the anchor construction it is practically impossible to haul the anchors up by means of the chains, and the anchors are therefore equipped with a hauling-up wire or anchor wire which is secured to the head of the anchor. When an anchor is to be taken up, a suitable vessel pulls in the anchor wire and thereby pulls the anchor off the bottom in such a way that the claws do not sink into the bottom, but are pulled loose from same. The anchor wires which are used e.g. for anchoring drilling vessels and semisubmerged drilling platforms in the North Sea are approximately 2½ inches in diameter and weigh 4–5 tons in the air and have a length of 450–500 inches. In order to get hold of these anchor wires, said wires are suspended from a buoy arrangement.

The disadvantage with this arrangement is that the wire and its connection with the buoy can easily slip loose because of the buoy's movement in the sea.

This results in the loss of buoys and wires and can easily lead to loss of the anchor. The buoy arrangement is large, heavy, dangerous and awkward to handle, and in addition is very expensive. An additional disadvantage is that onboard drilling ships or drilling platforms, heavy expensive racks are necessary for storing the buoys. This means increase in the drilling unit's deadweight and extra expenses.

The invention aims at eliminating the disadvantages mentioned above.

This is achieved according to the invention by placing the anchor-wire on the bottom of the sea and possibly by attaching a lifting-wire (dimension e.g. ⅝inch diameter) having a light buoy which floats up on the surface.

In this way one avoids having the anchor-wire and its connection with the buoy exposed to wear and tear from the buoy's movements in the sea, and one eliminates completely any loss of wires, expensive buoys and possibly anchors. The arrangement is light, small, labour-saving and cheap. A plastic material can be used in the buoy itself. The rack arrangement onboard the drilling unit can be eliminated entirely.

The invention will be explained more in detail as follows with reference to the drawing where examples are shown of the prior embodiment and an example of the embodiment according to the invention.

In the drawing of the arrangement according to the invention, 1 designates the anchor chain which is fastened at its upper end to a drilling unit or the like and is attached at its lower end to an anchor 2 which lies on the bottom. (In reality the anchor lies deeply embedded in the bottom of the sea.) An anchor-wire 3 is attached to the head of the anchor. It lies more or less drawn out on the bottom. To the free end of the anchor-wire 3 is attached a connecting piece to which is attached a grapnel 4 on a little anchor. In addition, a light cable or wire 5 runs up from the connecting piece to the surface where it is held up by means of a buoy. The grapnel 4 can as shown have four claws and a weight of approximately 200 kg. The lifting cable 5 can be a steel wire with a diameter of approximately ⅝inch. An extra buoy 6 can be attached to the lifting cable at a certain distance below the water surface. This can lie at a depth of 20–30 meters, so that it is not affected by heavy seas. The two buoys 6, 7 can be of reinforced PVC, polyester or the like and can be filled with foam material. The floating buoy 7 can be equipped with a marking light 8 so that the buoy is visible in the dark.

Having described my invention, I claim:

1. Arrangement of the pendant wire or chain for an anchor, where the pendant wire or chain is at one end fastened to the anchor head and is used for pulling loose and drawing up the anchor, a line with a smaller diameter than that of the pendant wire or chain and having one end fastened to the other end of the pendant wire or chain, which line has a length which is at least equal to the depth of the water at the anchoring location, a buoy fastened to the other end of the line, and a further anchor, lighter than the first-mentioned anchor, between said other end of the pendant wire or chain and said one end of said line.

2. Arrangement as claimed in claim 1, in which said pendant wire or chain is disposed loose on the sea floor.

3. Arrangement as claimed in claim 1, and a further buoy fastened to said line intermediate the ends thereof and disposed a substantial distance below the surface of the water.

* * * * *